United States Patent [19]

Taylor et al.

[11] Patent Number: 4,606,797

[45] Date of Patent: Aug. 19, 1986

[54] METHOD FOR RECOVERY OF HIGH GRADE GOLD ALLOY FROM KARAT GOLD-CLAD BASE METAL SUBSTRATES

[75] Inventors: Arthur D. Taylor, Foxboro; Roger W. Ramsey, Norton, both of Mass.

[73] Assignee: Engelhard Corporation, Menlo Park, N.J.

[21] Appl. No.: 775,070

[22] Filed: Sep. 12, 1985

[51] Int. Cl.[4] ..... C25F 5/00

[52] U.S. Cl. ..... 204/146

[58] Field of Search ..... 204/146

[56] References Cited

U.S. PATENT DOCUMENTS

| | | | |
|---|---|---|---|
| 1,996,985 | 4/1935 | Truthe | 204/109 |
| 2,185,858 | 1/1940 | Mason | 204/146 |
| 2,735,810 | 2/1956 | Gagliano | 204/146 |
| 3,663,388 | 5/1972 | Hedman, Jr. | 204/146 |
| 4,426,225 | 11/1984 | Ida | 75/118 R |
| 4,462,879 | 7/1984 | Castellanos | 204/109 |

*Primary Examiner*—T. M. Tufariello

[57] ABSTRACT

A method for recovering high grade gold alloy in an unoxidized condition from karat gold clad to a base metal substrate without significant oxidation of the substrate, wherein the substrate is employed as an anode in an aqueous solution of from about 0.02 to about 2% by weight nitric acid and is subjected to electrolysis at a temperature of from about 48° C. to about 94° C. for sufficient time to delaminate karat gold from the substrate in particulate form and deposit same in the solution, from which the delaminated karat gold may be separated. Also disclosed is an apparatus suitable for carrying out such process, comprising an electrolysis tank wherein the karat gold-clad base metal substrate is mounted in spaced relationship to a cathode, with filtration means disposed in the tank for collection of delaminated karat gold formed during the electrolysis, and means for draining or otherwise withdrawing electrolyte solution from the tank after termination of the electrolysis conditions, whereby the delaminated karat gold may be recovered from the electrolyte solution.

20 Claims, 3 Drawing Figures

METHOD FOR RECOVERY OF HIGH GRADE GOLD ALLOY FROM KARAT GOLD-CLAD BASE METAL SUBSTRATES

BACKGROUND OF THE INVENTION

1. Field Of The Invention

This invention relates to a method of and apparatus for recovering high grade gold alloy in an unoxidized condition from karat gold clad to a base metal substrate, such as, for example, nickel, silver, brass, copper and the like. More specifically, the invention relates to a method and apparatus of such type wherein the recovery of gold is effected without significant oxidation of the base metal substrate, under electrolysis conditions.

2. Description Of The Prior Art

In a general practice of the metals plating, jewelry and electronic circuitry arts, it has been common practice to reclaim precious metal values from scrap circuitry, used coated articles, scrap jewelry and the like. This has been particularly true in the case of gold, despite fluctuations in recent years in the market value thereof, and the prior art has proposed a great number of approaches for recovering this precious metal for reuse. Despite the number of possible processes heretofore employed or proposed in the art, all such methods have been characterized by various deficiencies which have limited their applicability or desirability in use.

U.S. Pat. No. 1,996,985 discloses a method for processing goldsmiths' waste residues containing precious metals such as gold, silver and platinum in addition to base metals such as copper, nickel and zinc. The residue precious metal-containing substrate according to the disclosed process is subjected directly to electrolysis in an electrolyte which is either faintly acid, neutral or slightly alkaline and contains salts of nitric acid. An exemplary solution for such purpose is copper nitrate faintly acidified by nitric acid in aqueous solution. As a result of such electrolysis, sludges are deposited on the cathode and anode, the cathodic sludge comprising metallic silver and copper, together with basic copper compounds, from which silver may be recovered in pure form by leaching of the cathodic sludge with diluted sulfuric acid; the anodic sludge is removed by scraping or otherwise from the anodes and contains the gold and platinum values of the substrate under treatment along with certain quantities of silver and some base metals. The anodic sludges are treated by extraction with nitric acid or sulfuric acid at elevated temperature to obtain a residue which is nearly free from silver and copper. The patent discloses that boiling of the anodic sludge in nitric acid is a suitable method for recovery of the crude gold.

The above-described prior art method of gold recovery suffers from several disadvantages. First, it is necessary to prepare an anode from the substrate metals by fusing and casting into a slab the discrete scrapings, sweepings, sludges or residues of the gold-containing material. Second, the electrolysis employed to recover the gold values includes a relatively high current density, which is disclosed as ranging from about 350 amperes per square meter at the anode, up to values on the order of 1,000 to 1,500 amperes per square meter in the case of materials which are relatively poor in precious metals content. Third, the recovery of gold from the anodic sludge involves boiling of the sludge in nitric or sulfuric acid, thus entailing handling and disposal problems associated with such high acid concentrations.

U.S. Pat. No. 2,185,858 discloses a method of removing gold, silver and/or palladium from a metal base material such as zinc, copper, brass or bronze. In the case of gold-clad metals, the substrate is made an anode in an electrolyte comprising a solution of concentrated sulfuric acid, wherein a cathode is disposed which is formed of nickel or other suitable cathode material. Upon electrolysis being initiated the sulfuric acid adjacent the anode is disclosed as being converted into persulfuric acid which dissolves the gold from the anode, but which passes from the immediate vicinity of the anode and then precipitates out from the acid and collects on the bottom of the electrolysis tank as substantially pure gold sludge. In order to minimize attack of the acid on the substrate metal, particularly in the case of brass, it is disclosed to maintain temperature in the electrolysis bath below 38° C. The disadvantages associated with this method of recovering gold again include the use of highly concentrated acids, as well as the fact that the gold, being deposited in the electrolysis solution in the form of a precipitated sludge, must be recovered from the electrolysis solution, and such recovery is subject to inefficiencies from material losses of the desired product gold.

U.S. Pat. No. 2,735,810 discloses a method for recovering gold from gold-clad material, which may contain other metals such as nickel, iron, tungsten, molybdenum and cadmium, wherein the clad substrate is subjected to electrolysis in a bath containing from about 3 to about 16% alkaline metal or ammonium ferrocyanide and from about 0.25% to about 8% alkali metal or ammonium cyanide. The electrolysis bath is maintained at a temperature of from about 20° C. to 80° C. (68° F. to 176° F.) and a pH of from about 7.5 to about 12. The ratio of ferrocyanide to cyanide in the bath is disclosed as being within the range of from 2:1 to 60:1. In this system the scrap metal functions as the anode and gold is deposited on the cathode, from which it may be scraped or otherwise removed. A current density of from 1 to 6 amperes per square foot is thought to have been satisfactorily employed. Among the problems associated with the use of this method, is the fact that disposal of the spent electrolysis bath requires treatment such as by chlorination in order to provide an effluent quality dischargeable stream from the process system. Further, the use of ferrocyanide and cyanide constituents in the electrolysis bath raises the danger of toxicity arising from hydrogen cyanamide generation during the carrying out of electrolysis. Further, the gold which is withdrawn from the anodic substrate deposits on the cathode, from which it must be scraped or otherwise mechanically removed, unless the cathode is gold or other substrate metal suitable for use in conjunction with the recovered gold.

In U.S. Pat. No. 3,663,388, there is disclosed a process for removing gold coating from a substrate, wherein the substrate is subjected to electrolysis to oxidize the gold coating under low voltage conditions, such as less than about 20 volts DC. The electrolysis solution may be a 1 molar (M) aqueous solution of an ammonium salt such as ammonium chloride and a 0.1 M solution of hydrochloric acid. The patent discloses that other salts may be substituted for ammonium chloride and other acids such as nitric acid may be used in place of the hydrochloric acid. In either case, the process is conducted to oxidize the gold. As the gold oxidizes, it blackens in color as the electrolysis solution functions as an etchant to etch the surface such that the oxidized gold adheres poorly to the substrate. Subsequently, the substrate may be removed from the electrolysis bath and the oxidized gold may be removed by wiping with a soft cloth or, alternatively, the etched substrate may be placed into an ultrasonic tank which vibrates the oxidized gold particles off the metal sheet. This gold removal process, as is also the case with various of the prior art methods described hereinabove, requires a two-step treatment of the gold-clad substrate. In the first step, the gold coating is oxidized and in the second step the oxidized coating is mechanically removed from the substrate, whereas in other prior art systems the electrodeposited gold must be mechanically or otherwise removed from one of the electrodes in the electrolysis system.

In addition, the gold product in this system is in the form of an oxide which is unsuitable in many applications for reuse without further treatment to reduce the gold oxide to pure metallic gold product.

U.S. Pat. No. 4,426,225 discloses a method for recovering gold in flake form from substrate materials wherein the gold is deposited on an intermediate layer of copper, nickel, tin and alloys thereof, in which the base of the substrate is insoluble in the method of the invention. The disclosed method comprises the first step of contacting the gold-containing scrap material with an aqueous nitric acid etching solution, which functions by preferentially etching away the intermediate metallic layer, effectively chemically tunneling under the gold coating. As a result, the gold coating has progressively loosened and flaked off into the etching solution. This first step produces a pregnant etching solution comprising gold flakes in a liquor comprising nitrates of the metals comprising the underplating. The second step of physically separating the gold flake from the pregnant etched liquor is carried out by any suitable conventional means such as filtration or centrifugal separation. The etchant solution employed in the method of this patent is approximately 50% by weight nitric acid in aqueous solution. It is also disclosed to employ additives such as phosphates and citric acid to enhance the recovery of gold by providing a frothing action that overcomes surface tension induced by the adherence of gold flake to the substrate. The etching step of this process is suitably carried out for a period of time on the order of 2 hours to 4 hours at ambient temperature. Among the disadvantages of this method are the facts that high concentrations of acid are required and the treatment time for the etching step is comparatively long in duration.

In the gold recovery process disclosed in U.S. Pat. No. 4,462,879, gold or gold scrap is melted and inquarted using copper or other non-ferrous metals or, in the case of platiniferous gold, silver. The resultant gold copper or gold silver alloy slab is employed as an anode in an electrolytic cell employing an aqueous nitric acid solution, wherein the electrolysis solution contains 28% by weight nitric acid, in addition to a disodium salt of ethylenedinitrilotetraacetic acid (EADS) which functions as a detergent or emulsifying agent preventing refined gold particles falling from the anode during electrolysis from floating in the electrolyte solution, and also prevents polarization of the anodes which is stated to impede the process. The electrolytic conditions in this system includes a current density of 2–2.5 amps per square inch of anode surface, at a voltage of 3–5 volts. As a result of the electrolysis being carried out, the base metal such as copper is dissolved in the electrolyte solution, concurrent with the gold in the anodic body precipitating to the bottom of the container as a mud or slime residue. The electrolytic solution then is filtered from the slime which is boiled in concentrated nitric acid or washed with ammonia hydroxide. The resultant gold mud is again filtered, washed thoroughly with distilled water, dried and heated to a molten state at a purity on the order of 99.9%. Among the disadvantages of this process are again a relatively high concentration of nitric acid in the electrolytic solution, and a requirement of boiling the gold slime in concentrated nitric acid or ammonia hydroxide, either of which must be neutralized for disposal.

In summary, the methods of the prior art in general require highly concentrated acid solutions for etching or electrolysis removal of gold from a substrate or else mechanical removal such as by scraping from an electrode on which the gold is deposited or else reconcentration and purification where gold is deposited as a precipitate in the etching or electrolysis solution. As indicated, various of the prior art methods require considerable time for recovery of the desired product gold and in others the substrate is substantially oxidized or dissolved into solution, with the attendant requirement of treatment to precipitate or otherwise concentrate such base metal component of the spent electrolytic bath liquor.

In this connection, it is to be noted that in many applications it is desired to simply remove the gold cladding from the substrate without adverse effect on the character of the substrate, such as oxidation or dissolution thereof, so that the substrate may be directly utilized after the treatment step for gold recovery. This is particularly the case in jewelry or microelectronic circuitry systems, wherein the gold may be plated on a substrate metal such as nickel or silver-coated nickel and the base metal thus has significant reuse value so that any deterioration or oxidation thereof is detrimental to such reclamation of it.

SUMMARY OF THE INVENTION

The method aspect of the present invention provides for recovering high grade gold alloy in an unoxidized condition from karat gold clad to a base metal substrate, without significant oxidation of the substrate, comprising the steps of:

(a) subjecting the karat gold-clad substrate to electrolysis as an anode in an electrolytic circuit including a cathode and an aqueous solution of from about 0.02 to about 2%, preferably from about 0.02 to about 1%, by weight nitric acid, based on the total weight of the solution, the electrolysis being carried out at a temperature of from about 48° C. to about 94° C., preferably from about 65° C. to about 94° C., more preferably from about 82° C. to about 91° C., for sufficient time, e.g., about 5 to 25 minutes, to delaminate karat gold from the substrate in unoxidized form and deposit same in the solution; and (b) separating the delaminated karat gold from the solution.

The apparatus aspect of the present invention provides an apparatus for recovering high grade gold alloy in an unoxidized condition from karat gold clad to a base metal substrate, without significant oxidation of the substrate, comprising:

(a) an electrolysis tank;

(b) a cathode, preferably made of stainless steel, and mounted for submersion in the tank;

(c) mounting means for mounting the karat gold-clad base metal substrate for submersion in the tank in spaced relationship to the cathode;

(d) means for establishing an electrical circuit coupling the cathode and the karat gold clad base metal substrate when the cathode and the karat gold-clad base metal substrate are submerged in electrolyte solution in the tank;

(e) means for continuously introducing as the electrolyte solution to the tank, an aqueous solution of from about 0.02 to about 2%, preferably from about 0.02 to about 1%, by weight nitric acid, based on total weight of the solution;

(f) means for continuously discharging electrolyte solution from the tank, by overflow therefrom;

(g) heating means for maintaining electrolyte solution in the tank at a temperature of from about 48° C. to about 94° C.;

(h) filtration means disposed in the tank for collection of delaminated karat gold formed during electrolysis of the karat gold-clad base metal substrate therein; and (i) means for withdrawing electrolyte solution from the tank, e.g., means for draining the tank, after termination of the electrolysis.

As used herein and in the claims, a "base metal substrate" as used in reference to the metallic moiety or article to which karat gold is clad, refers to a metallic body which is not significantly soluble under electrolysis conditions of the invention in the aqueous nitric acid solution employed therefor, i.e., is not significantly soluble in 0.2 to about 2% by weight aqueous nitric acid solutions under such electrolysis conditions, and which additionally is not significantly oxidized in such dilute nitric acid solutions under the electrolysis conditions of the method of the invention. The base metal substrate thus may be composed of a metal such as nickel, silver-clad nickel, brass or copper, either in pure form or alloyed with metals such as zinc, tin and other common alloying metals used in commercial practice. As used herein and in the claims, "karat gold" refers to gold alloys containing at least 30% gold by weight and "high grade gold alloy" refers to the gold alloy produced by the process of the present invention which has a gold content by weight at least equal to the karat gold from which it is recovered.

Generally, the present invention provides a method for recovering high grade gold alloy in an unoxidized condition from karat gold clad to a base metal substrate without significant oxidation of the base metal substrate to which the gold is clad. Among the advantages of the invention are the facts that it provides a method for recovering high grade gold alloy which does not require concentrated solutions of acid and which is readily effected in a short period of time.

These and other advantages of the invention will be apparent from the ensuing disclosure and appended claims.

DETAILED DESCRIPTION OF THE PREFERRED EMBODIMENTS

Figure 1:
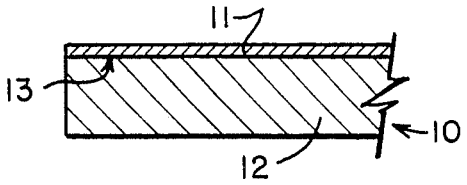
FIG. 1 is a sectional elevational view of a portion of a gold-clad base metal substrate, wherein the gold cladding is deposited onto a unitary base metal substrate.

The present invention is based on the discovery that high grade gold alloy may be recovered from karat gold-clad base metal substrates by electrolysis under elevated temperature conditions using a very dilute aqueous solution of nitric acid. The combination of a dilute nitric acid aqueous electrolytic solution and elevated temperature conditions obviates the need for long processing times as is characteristic of various of the prior art systems; additionally, the dilute acid concentrations involved minimize the hazards and difficulties associated with the use and disposal of the electrolyte solution relative to the concentrated acid baths of the prior art. Most importantly, however, the method of the invention has been found to enable recovery of high grade gold alloy in unoxidized condition, and without significant oxidation of the base metal substrate from which the gold is obtained. By means of the process of the invention, removal of unoxidized gold from the base metal substrate may be readily affected to levels on the order of 90 to 100% recovery of the gold, relative to the amount initially present on the base metal substrate, in short periods of time on the order of from about 5 to about 25 minutes.

Specifically, the electrolytically active conditions of the present invention are those which, in the 0.02 to about 2% by weight nitric acid electrolytic solution, and at temperature of from about 48° C. to about 94° C., are sufficient to delaminate the karat gold from the substrate in unoxidized particulate form. It will be apparent to those skilled in the art that the specific electrolytic conditions of current, voltage and current density may be varied widely, depending on the thickness of the gold cladding which is to be treated by the method of the invention, the specific temperature employed and the specific concentration of nitric acid in the electrolytic solution. Accordingly, such specific current, voltage and current density conditions for the electrolysis step may be readily determined without undue experimentation to determine those conditions which may be utilized to best advantage for the gold-clad base metal substrate being treated.

Within the broad generality of the foregoing, it has been found advantageous in the general practice of the invention, specifically in the case of processing gold-clad nickel or silver-coated nickel substrates, to utilize a voltage in the range of from about 0.5 to about 25 volts, preferably from about 5 to about 20 volts, an amperage of from about 0.5 to about 150 amps, preferably from about 50 to about 125 amps, and a current density, measured at the anode, of from about 0.05 to about 10 amps/ft$^2$.

As broadly indicated, the nitric acid concentration in the aqueous electrolyte solution may range from about 0.02 to about 2% by weight, based on the total weight of the solution, preferably from about 0.02 to about 1% by weight, and most preferably from about 0.03 to about 0.06% by weight. Relative to the broad range of about 0.02 to about 2% by weight nitric acid, nitric acid concentrations below the lower limit of about 0.02 have been found to provide insufficient electrolytic action on the gold cladding for efficient recovery at low voltage, low amperage conditions within a relatively short period of time; conversely, nitric acid concentrations above about 2% by weight have been found to tend to promote unacceptable levels of oxidation of the base metal substrate.

For the same general reasons, the temperature employed is in the range of from about 48° C. to about 94° C., since temperatures below about 48° C. provide insufficient electrolytic activity at the desired low voltage and low amperage conditions for high recovery of gold in the relatively short period of time contemplated by the invention as desirable for commercial practice. Temperature levels above about 94° C., on the other hand, again tend to promote unacceptably high levels of oxidation of the base metal substrate and in addition raise evaporative losses of water from the electrolyte solution to levels which increase the nitric acid concentration to unacceptably high levels.

Within the broad temperature range of from about 48° C. to about 94° C., it is preferred to utilize a temperature in the range of from about 65° C. to about 94° C., most preferably from about 82° C. to about 91° C., as a balance of the foregoing considerations indicated in connection with the upper and lower limits of the temperature range useful in the invention.

The aqueous nitric acid electrolytic solution suitably may be formed from deionized water, and it is preferred to utilize such deionized water having a resistance under the electrolytically active conditions of the process, of at least about 5.0 megaohms.

The electrolytically active conditions utilized in the practice of the present invention advantageously comprise the establishment of an electrolytic circuit including a cathode which is inert to nitric acid, such as, for example, of stainless steel, for example "316 stainless." It is suitable in the broad practice of the invention to space the cathode from the anode (karat gold-clad base metal substrate) in the aqueous nitric acid solution by a distance which may vary from about 5 cm. to about 25 cm. As the case of suitable specific voltage, current and current density conditions, the appropriate spacing between electrodes at a given application may readily be determined by simple experimentation without undue burden. Generally, however, cathode-to-anode spacings of less than about 5 cm. tend to produce "shadowing" of the base metal substrate anode by the cathode, with result that the electrolytic "overlapping" resulting therefrom prevents removal of the gold in the shadowed areas to the high extent otherwise obtained in the "unshadowed" areas of the anode. At cathode-to-anode spacings greater than about 25 cm., the electrolytic coupling between the cathode and anode becomes sufficiently attenuated that the rate of gold removal from the anode is correspondingly reduced, frequently to unsuitably low levels.

As hereinafter described in greater detail, the electrolysis in the method of the present invention may advantageously be carried out with agitation of the aqueous electrolytic solution during the electrolytically active conditions, thereby enhancing delamination of karat gold from the substrate.

Figure 2:
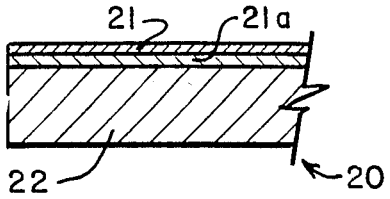
FIG. 2 shows a sectional elevational view of a portion of a gold-clad base metal substrate wherein the gold is deposited on an intermediate metallic layer which in turn is joined to a metal core.

The process of the present invention is broadly applicable to karat gold-clad base metal substrates of the type shown in FIGS. 1 and 2, the former showing a metallic article 10 comprising a karat gold layer 11 deposited on a unitary base metal substrate 12, which may for example be formed of nickel, brass, copper, tin, zinc or other suitable constituent, wherein the gold layer 11 has a discrete interface 13 at its juncture with the base metal substrate 12; the invention is also applicable to multilaminar metallic articles 20 of the type shown in FIG. 2, wherein the karat gold layer 21 is deposited on an intermediate layer 21*a*, which in turn is deposited on the metallic core 22. The system of FIG. 2 may suitably comprise a silver cladding as the intermediate layer 21*a* on a metallic core 22 of nickel.

While it is not desired to be bound by any particular theory as to the mechanism of operation of the present invention, it is believed that the internal resistance of the aqueous nitric acid electrolytic solution has an important effect in rendering the karat gold layer deposited on the base metal substrate permeable to the electrolytic nitric acid solution, so that the electrolyte effectively operates at the interface between the gold layer and the adjacent substrate or intermediate sub-layer. Accordingly, it is believed, on the basis of work to date, that an electrolysis solution of about 0.03 to about 0.06% aqueous nitric acid solution, particularly about 0.05% nitric acid, may provide optimal operation where the aqueous component of the solution is deionized water, due to the specific internal resistance level provided thereby. Karat gold invariably contains an oxidizable alloying component, such as copper, which is susceptible to action by the nitric acid component of the electrolytic solution to render the gold layer permeable where such gold alloy layer is present as the cladding on the base metal substrate; alternatively, in the case of pure gold layers deposited on the base metal substrate, which is also contemplated within the meaning of "karat gold" in the present invention, the interface between the gold layer and the adjacent metal sub-layer provides a surface area, or region, which is susceptible to action of the nitric acid-containing electrolytic solution.

As used herein and in the appended claims, the term "clad" is intended to be broadly construed to include conventional hot cladding operations wherein a thin layer of pure gold is hot-rolled with the metallic core, or metallic core and intermediate sub-layer, as well as to refer to systems wherein a gold or gold alloy layer is deposited on a metallic core or substrate by any suitable deposition or application coating method. In systems where pure gold is deposited on the core, or core and intermediate layer substrate, current density at the anode in the electrolysis circuit is higher at the gold-core or gold-intermediate sublayer interface than on the planar face of the gold layer parallel to the interface. Such increased interfacial current density is believed to result in the electrolyte preferentially acting at the exposed interface and progressively weakening the bond between the pure gold layer and the underlying metal on which such gold is deposited.

During the electrolysis step of the method of the present invention, the gold layer deposited on the base metal substrate blisters as the gold/substrate metal interface is acted on by the nitric acid-containing electrolytic solution. Concurrently, the cathode provides a reception site for deposition of alloying metals from the karat gold layer, such as copper, and other precious metal constituents of the system such as silver. The base metal substrate has been found to be relatively unsusceptible to oxidation under the mild conditions utilized in the process of the present invention. Generally, not more than about 0.5% of the substrate base metal is oxidized, such as in the case of a nickel substrate, and even where readily oxidizable materials such as brass are utilized as a substrate, not more than about 2 to 4% of the substrate is oxidized.

As a result of the gold recovery process of the present invention, gold is recovered in the electrolysis step in the form of gold flakes or strips, often in a shape resembling Christmas tree tinsel, i.e., in the form of strips or strip segments of karat gold.

Specific tests of the process of the present invention have shown same to be highly effective in removal of karat gold layers from base metal substrate such as nickel, silver-clad nickel, brass and copper. The process of the present invention is most efficient in systems wherein the base metal substrate is formed of a metal which is less susceptible or in any event not any more susceptible to nitric acid oxidation under the treatment conditions utilized than is nickel under such conditions.

As indicated, the electrolytically active conditions of the present invention may suitably comprise a voltage of from about 0.5 to about 25 volts and an amperage of from about 0.5 to about 150 amps. The current density utilized in accordance with such voltage and amperage levels will depend in a given system on the thickness of the gold layer to be treated and the particular proportions of the cathode-to-anode areas utilized, which, as indicated, may be readily determined by one of ordinary skill in the art without undue experimentation.

Figure 3:
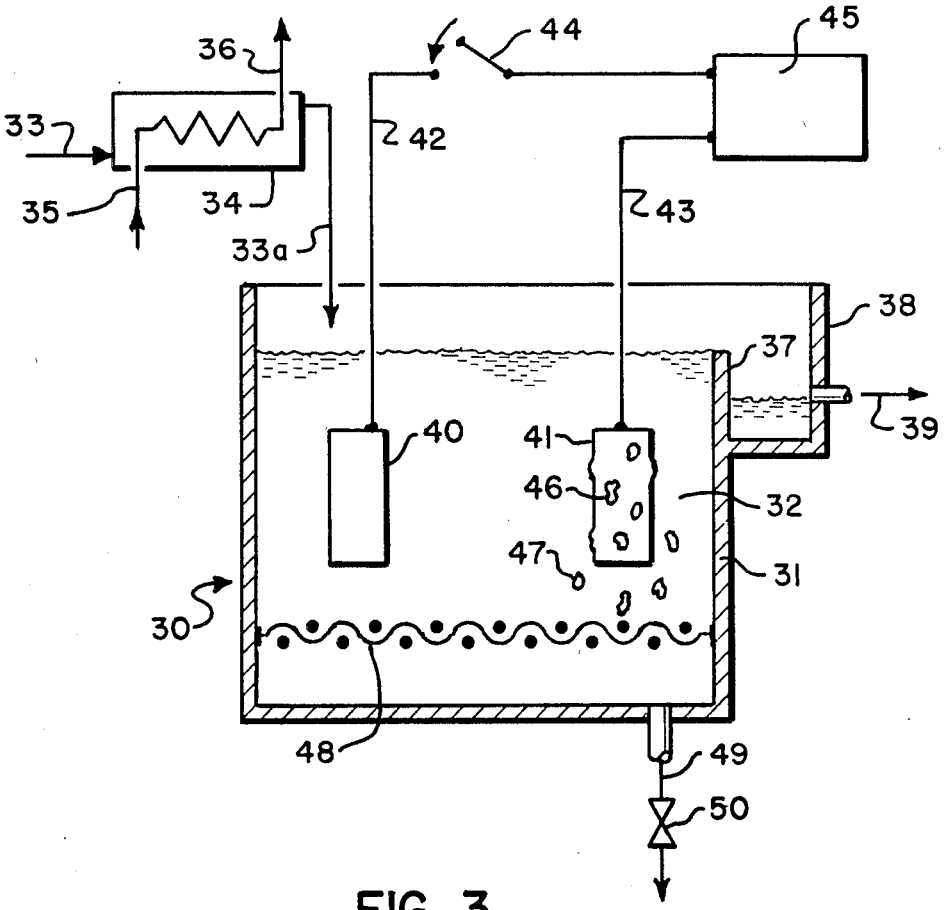
FIG. 3 is a schematic diagram of a process system according to the present invention, wherein recovery of high grade gold alloy from gold-clad base metal substrates may be effected.

Referring now to FIG. 3, there is shown a schematic diagram of an electrolysis system suitable for carrying out the practice of the process of the instant invention. Aqueous solution of from about 0.02 to about 2% by weight nitric acid, based on the total weight of the aqueous solution, enters the system from a source of same (not shown) in line 33 from which the aqueous solution is passed to heat exchanger 34, wherein it is heated to a temperature of from about 48° C. to about 94° C. by a hot fluid medium such as steam or hot ethylene glycol entering the heat exchanger in line 35 and being discharged therefrom in line 36. The thus-heated aqueous nitric acid solution is discharged from the heat exchanger 34 in line 33*a* from which it is introduced into the electrolysis system 30.

The electrolysis system comprises electrolysis tank 31, which may be of conventional construction formed from steel or other ferrous metal or alternatively polypropylene or other polymeric material; in the event that the electrolysis tank 31 is composed of a conductive metal, it may be advantageously lined with a rubber lining or other insulant barrier, as is conventional in the electrolysis art. The electrolysis tank as shown comprises an overflow wall 37 communicating with a weir channel 38, from which spent electrolysis solution is discharged in line 39. In this manner, the electrolysis solution is discharged from the tank 31 by overflow, thereby providing gentle agitation in conjunction with continuous introduction of electrolysis solution in line 33*a* to the tank, whereby the tank contents are gently agitated while maintaining substantially constant in volume.

The karat gold-clad base metal substrate 41 is disposed in the electrolysis tank as an anode, coupled by electrical circuit coupling means 43 (wires) to a power source 45, which may suitably comprise a DC voltage generator providing a voltage in the range of from about 0.5 to about 25 volts. The power source 45 is coupled by circuit means (wires) 42 containing an actuatable switch 44 to the cathode 40, which as indicated may suitably be of stainless steel or other conventionally employed anode material as known in the art.

Upon closure of the switch 44, the power source 45 provides flow of current through the electrolytic circuit formed by cathode 40, anode 41 and electrical circuit coupling means 42 and 43.

Upon initiation of electrolytically active conditions by closure, manually or automatically, of switch 44, the karat gold coating on the anode 41 begins to delaminate by the formation of blisters 46, which by continuous action fracture from the base metal substrate and fall from the anode 41 surface as particulates of karat gold 47. These deposited particulates are then collected on the filter screen 48 which is jointed at its perimetric margins by soldering or other joining means to the inside walls of the electrolysis tank 31.

After the electrolytically active conditions have been continously carried out for a period which may suitably be on the order of from about 5 to about 25 minutes, resulting in the deposition on filter screen 48 of substantially all of the karat gold previously coated on the anodic base metal substrate, the switch 44 is opened to discontinue the electrolysis conditions, followed by opening of the valve 50 in drainage conduit 49, the valve having previously been closed during electrolysis operation. Simultaneous with the opening of switch 44 to terminate the electrolysis conditions, the influx of electrolytic solution in line 33 and egress of electrolytic solution from the electrolysis tank in line 39 is advantageously terminated, so that upon opening of the valve 50, the tank contents are drained to leave the deposited karat gold particulates 47 collected on the filter screen 48. In the general practice of the present invention, particularly in systems where gold is deposited on substrates such as nickel and silver-clad nickel, the gold particulates 47 have a size which is roughly on the order of 1 to about 2.5 cm. Accordingly, it is advantageous in such systems for the filter screen 48 to have an aperture size of less than about 1 cm., or a mesh size less than about 2.5. It will be apparent that in any specific system, the mesh size should be as small as is consistent with maximum collection of the delaminated and deposited gold particulates 47.

The overflow discharge weir arrangement of the electrolysis tank in FIG. 3 is highly advantageous in operation, since it permits a constant liquid level and a constant volume of electrolysis liquid solution to be maintained in the tank 31, while the overflow of liquid at the weir discharge wall 37 provides in conjunction with constant introduction of electrolysis solution to the tank in line 33*a*, a gentle agitation condition in the tank which is conducive to enhancing the delamination of the karat gold from the substrate 41. In addition, or as an alternative, the electrolysis solution contents of the tank may be agitated as by mechanical mixing means (not shown), such as an agitator or low speed propeller mixing means. Further, as an alternative to the use of the heat exchanger 34 in line 33 for heating of the electrolysis solution to a temperature in the range of from about 48° C. to about 94° C., it may be suitable or desirable in some applications to instead provide a heat exchange coil in the liquid volume in tank 31, or a heat exhange jacket around tank 31 for heating of its interior contents, in a manner as well known in the art.

The operation of the present invention will be more fully appreciated by the following examples which are intended to be illustrative only and not to in any way limit the scope or applicability of the present invention. In all examples hereinafter set forth, all parts and percentages are by weight, unless otherwise expressly stated.

EXAMPLE 1

An aqueous nitric acid solution containing 2% nitric acid in deionized water of at least 5 megaohms resistance, with such solution being introduced into a suitable electrolysis vessel wherein a stainless steel cathode is disposed joined by electrical leads to a DC rectifier power source. A ten karat gold-clad nickel base material is positioned in the electrolytic solution in the vessel, connected by a corresponding electrical lead to the DC power source. The cathode and anode are separated in the vessel by at least 5 cm. The DC power source is actuated and the cathode/anode separation distance is adjusted until the voltage therebetween is on the order of about 1.5 volts and the current in the electrolysis circuit is about 1.5 amps. The electrolysis conditions are continued, while the temperature of the electrolysis solution in the vessel is in the range of from about 82° C. to about 91° C. The electrolytically active conditions are maintained for a period of between 5 and 20 minutes. During such conditions, the gold alloy on the nickel substrate blisters and falls to the bottom of the solution tank as particulates each approximately 1–2 cm. in diameter.

EXAMPLE 2

The general procedure of Example 1 is carried out for a period of three minutes with periodic mixing of the electrolysis solution. The gold alloy removed in the form of particulates is collected from the electrolysis vessel, washed twice with deionized water and then dried over a hot plate. Visual inspection of the gold particulates shows same to be shiny, thereby evidencing the fact that the gold is not oxidized to any appreciable extent during the electrolysis operation.

EXAMPLE 3

A karat gold-clad base metal substrate, comprising a ten karat gold layer deposited on a silver intermediate layer, in turn deposited on a nickel core, wherein the gold layer has a gold content which is 0.7% by weight of the total weight of the gold-clad silver plated nickel substrate, is generally representative of jewelry scrap, such as deriving from materials utilized in forming metallic watchbands. Such scrap article is disposed in an electrolysis tank together with a 316 stainless steel cathode electrically coupled thereto. The electrolytic solution in the tank is a 0.05% solution of nitric acid in deionized water, at a temperature of 85° C. The electrolysis conditions are initiated, comprising a voltage of ten volts and an amperage of 50 amps. The karat gold layer on the anodic surface is observed to blister and flake off in the form of small-sized particulates having a diametric dimension on the order of from about 1 to about 2½ cm. The deposited gold particulates are separated from the electrolysis solution after termination of the electrolytic conditions and upon assay are found to contain at least 42% by weight of gold, the level of gold content in the karat gold cladding on the silver-plated nickel substrate initially introduced into the electrolysis tank. The silver plate layer is removed during the electrolysis, leaving as the anodic surface a stripped nickel base.

EXAMPLE 4

The procedure of Example 3 is continued for about 20 minutes, resulting in substantially 100% recovery of gold from the anode in unoxidized form.

While the present invention has been described in detail with reference to specific embodiments thereof, it will be appreciated that those skilled in the art may, upon reading and understanding of the foregoing, conceive of alterations and modifications thereto which alterations and modifications are believed to be within the scope and spirit of the invention and the appended claims.

What is claimed is:

1. A method of recovering high grade gold alloy in an unoxidized condition from karat gold clad to a base metal substrate, without significant oxidation of said substrate, comprising the steps of:

(a) subjecting said karat gold-clad substrate to electrolysis as an anode in an electrolytic circuit including a cathode and an aqueous solution of from about 0.02 to about 2% by weight nitric acid, based on the total weight of said solution, the electrolysis being carried out at a temperature of from about 48° C. to about 94° C. for sufficient time to delaminate karat gold from the substrate in unoxidized form and deposit same in said solution; and (b) separating the delaminated karat gold from said solution.

2. The method of claim 1 including maintaining an electrolysis voltage of from about 0.5 to about 25 volts.

3. The method of claim 1 including maintaining an electrolysis amperage of from about 0.5 to about 150 amps.

4. The method of claim 1 wherein said temperature is from about 65° C. to about 94° C.

5. The method of claim 1 wherein said temperature is from about 82° C. to about 91° C.

6. The method of claim 1 wherein said aqueous solution comprises from about 0.02 to about 1% by weight nitric acid, based on the total weight of said solution.

7. The method of claim 1 wherein said aqueous solution comprises from about 0.03 to about 0.06% by weight nitric acid, based on the total weight of said solution.

8. The method of claim 1 including maintaining an electrolysis voltage of from about 5 to about 20 volts.

9. The method of claim 1 including maintaining an electrolysis amperage of from about 50 to about 125 amps.

10. The method of claim 1 wherein said aqueous solution comprises deionized water.

11. The method of claim 10 wherein said deionized water has a resistance under said electrolytically active conditions of at least about 5.0 megaohms.

12. The method of claim 1 wherein said cathode is inert to nitric acid under the defined electrolysis conditions.

13. The method of claim 12 wherein said cathode is spaced from said anode in said aqueous solution by a distance of from about 5 cm. to about 25 cm.

14. The method of claim 12 wherein said cathode is made of stainless steel.

15. The method of claim 1 wherein the current density at said cathode is from about 0.05 to about 10 amps/ft$^2$.

16. The method of claim 1 including carrying out said electrolysis for a period of from about 5 to about 25 minutes on a given specimen of said karat gold-clad substrate.

17. The method of claim 1 comprising agitating said aqueous solution during said electrolysis, thereby enhancing the delamination of said karat gold from said substrate.

18. The method of claim 17 wherein said agitation of said aqueous solution is effected by conducting said electrolysis in an electrolysis tank from which said aqueous solution is continuously discharged by overflow therefrom while replenishment aqueous solution is continuously introduced into said tank, whereby the volume of said aqueous solution contained in said tank is maintained substantially constant.

19. The method of claim 1 wherein said delaminated karat gold is separated from said aqueous solution by filtration thereof.

20. The method of claim 1 wherein said base metal substrate is selected from the group comsisting of nickel, silver-clad nickel, brass and copper.

* * * * *